United States Patent [19]

Hehl

[11] 3,994,750

[45] Nov. 30, 1976

[54] METHOD OF PRODUCING ABRASION RESISTANT PLASTIFICATION ELEMENTS FOR INJECTION MOLDING MACHINES

[76] Inventor: Karl Hehl, Arthur-Hehl-Str. 32, 7291 Lossburg, Germany

[22] Filed: Feb. 10, 1975

[21] Appl. No.: 548,751

[30] Foreign Application Priority Data

Feb. 16, 1974 Germany ..... 2407540

[52] U.S. Cl. ..... 148/6; 148/6.35; 148/14; 148/143

[51] Int. Cl.[2] ..... C23C 9/07

[58] Field of Search ..... 148/6, 6.35, 14, 16, 148/16.7, 125, 144, 143, 153

[56] References Cited

UNITED STATES PATENTS

| | | | |
|---|---|---|---|
| 2,921,877 | 1/1960 | Samuel et al. | 148/14 |
| 3,222,228 | 12/1965 | Stanley et al. | 148/16 |
| 3,325,313 | 6/1967 | Galmiche | 148/144 X |
| 3,567,527 | 3/1971 | Pevar | 148/144 X |
| 3,806,374 | 4/1974 | Krzyminski | 148/6 |

*Primary Examiner*—Ralph S. Kendall
*Attorney, Agent, or Firm*—Joseph A. Geiger

[57] ABSTRACT

A method of producing highly abrasion resistant plastification screws and plastification cylinders for injection molding machines in which plastic materials with abrasive fillers are processed, the machined plastification elements being borided in a boron carbide packing and then hardened or tempered, the method involving the selection of a tool steel or temper steel whose austenitization temperature is below the highest boriding temperature, so that the elements can be hardened or tempered immediately after the boriding treatment, by chilling them with an inert gas, while they are still in contact with the boriding packing.

14 Claims, No Drawings

METHOD OF PRODUCING ABRASION RESISTANT PLASTIFICATION ELEMENTS FOR INJECTION MOLDING MACHINES

BACKGROUND OF THE INVENTION

1. Field of the Invention

The present invention relates to a method of producing highly abrasion resistant machine elements, and more particularly to a method of producing abrasion resistant plastification elements, such as plastification screws and plastification cylinders for injection molding machines, using temper steel or tool steel which is suitable for surface treatment by boriding, the plastification elements being particularly suitable for use in conjunction with the injection molding of thermoplastic and thermo-setting plastic materials containing mineral fillers, metallic fillers, or other highly abrasive fillers.

2. Description of the Prior Art

It is known in the prior art to increase the surface hardness of plastification elements by subjecting the machined elements to a boriding treatment, packing them in boron carbide powder inside a suitable container which is then placed into a pre-heated compartment furnace and heated at the required boriding temperature, viz. between approximately 800 and 1100° C. Upon termination of this treatment, the containers are removed from the furnace and cooled in still air. After cooling, the plastification elements are removed from the steel sheet container and, to the extent that these elements are plastification cylinders and the boron carbide powder had been preferably filled into the bore of the cylinder, the former is removed from the bore. The necessary tempering treatment, or hardening treatment, as the case may be, is then performed in a separate operation. Heating to the hardening or tempering temperature is performed in an inert salt bath or inside an inert gas furnace. A comparatively mild chilling rate assures that no distortions are created in the borided surface zone so that crack formation is avoided. Experience has shown that this method produces the heaviest and best spiked borided zones, when it is used on non-alloyed and low-alloyed steels. On the other hand, it was found that, when steel with a chromium content in excess of approximately 6 percent is used, the boride zone adjoins the matrix almost smoothly, with the resulting tendency of shearing off under certain stress conditions (Kunst: "Neuere Verfahren zum Erhohen der Lebensdauer von Schnecken zum Verarbeiten von Kunststoffen", in Kunststoffe, Vol. 62, Issue No. 11, 1972).

Using the above-described heat treatment method, it has further been found, for example, that a plastification screw made of steel having the designation 50 CrMo 4, when used in conjunction with the injection molding of thermo-setting plastic material with a mineral filler, had its operative life increased by a factor of 26, as compared to the previously used plastification screw. Other steels which have been found to be suitable for this purpose are steels designated 42 CrMo 4 and 50 CrMo 4 (*Kunststoffberater*, Vol. 19, Issue No. 1, page 21).

Research concerning the spike formation in the transition zone between the boride zone and the base steel has further revealed that, in contrast to the spike-suppressing, i.e. smoothening tendency of the alloy components molybdenum, tungsten, chromium and vanadium, the alloy component nickel does not exhibit the same undesirable influence on the micro-spike formation in the boride phase, even when present in a concentration of up to 9 percent. This fact has been demonstrated in connection with an air-hardening steel of the designation X 8 Ni 9 - Steel No. 1.5662 (*Oberflachentechnik*, No. 11/1972, pages 431–436).

From a still further research report is known that borided alloyed steels can be quenched in oil, following removal from the salt bath in which they are heated to the required hardening temperature. According to this source, such treatment does not affect the shape or hardness of the boride zone (*Metall*, Issue No. 1, Jan. 1973, pages 10–13, esp. p. 12).

Lastly, it is also known that the presence of certain alloy components in the steel, especially the presence of chromium, molybdenum, tungsten, and/or vanadium, as well as carbon, tends to inhibit the growth of the boride zone, in addition to the earlier-mentioned inhibition of the spike formation. It has therefore been recommended to restrict the heat treatment to elements having a relatively thin boride zone (*DURFERRIT-Technische Mitteilungen*, Durf 21-0-2-573 Bi).

SUMMARY OF THE INVENTION

Underlying the present invention is the primary objective of devising an improved treatment method, while building upon the above known teachings, whereby the results of the earlier-mentioned boriding treatment and heat treatment are obtainable in a much more efficient and economical way.

The present invention proposes to attain this objective by suggesting that the plastification elements, or other highly abrasion resistant machine elements, be manufactured from a tool steel or temper steel whose austenitization temperature lies below the highest recommended boriding temperature, so that a single temperature level provides both the boriding temperature and the austenitization temperature, meaning that the chilling operation can advantageously be performed directly after the boriding operation.

With this novel method it becomes possible to manufacture the plastification elements from low-alloy, relatively inexpensive tool steels or temper steels, whose ferro-boride ($Fe_2B$) zone, when tested for hardness with 100p, shows a Vickers hardness of 1800–2000 kp/mm$^2$, and which retain a very high degree of toughness in the base material so that the hardened boride layer will not break, even under elevated compression stress, and will be tough enough to withstand extreme shear stress. The overall result is a considerable reduction in the manufacturing cost of highly abrasion and wear resistant machine elements.

For this purpose, the invention further suggests that the tempering or hardening operation on the plastification elements be performed at a minimal chilling rate which corresponds to a cooling line in the Time-Temperature Transformation Diagram for Continuous Cooling that does not intersect the Pearlite Range of the TTT-Diagram and which also remains outside of, or only slightly intersects the Intermediate Range.

Additional considerable economies of production result from the fact that the tempering or hardening treatment of the plastification elements, as proposed by this invention, can be performed as a mild chilling operation in a gaseous medium, while the elements remain in contact with their boron carbide powder packing.

A suitable device for performing the novel method of the invention preferably includes a compartment furnace, having a boriding compartment for the boriding step and an adjacent cooling compartment for the subsequent chilling step, thereby giving the plastification elements the desired temper. The cooling compartment is preferably arranged above the boriding compartment, both compartments being surrounded by a common insulating jacket.

EXAMPLES OF APPLICATION OF THE METHOD

In the following are given several examples of applications of the method of the invention, indicating preferred operational details for each case:

EXAMPLE NO. 1

A plastification screw machined from a forging die steel of the designation 55 NiCrMoV 6 (Steel No. 2713 - DIN Standards, nominally containing 0.55% C, 0.85% Cr, 0.3% Mo, 1.65% Ni, and 0.1% V) is packed inside an elongated container of heat resistant steel sheet, in a packing of boron carbide powder. A corresponding plastification cylinder is packed with boron carbide powder by filling its bore with the powder, using a central spacer tube, if necessary. The elements are borided in a compartment furnace for 6 hours duration, at a temperature of approximately 920° C. Following boriding, the plastification elements, together with their surrounding packing, or enclosed packing, respectively, are moved vertically upwardly into a cooling zone located above the compartment furnace, where the elements are air-chilled to room temperature in 2½ hours of continuous cooling. Since the austenitization temperature of the steel used is 850° C, the foregoing cooling operation satisfies the required mild chilling, meaning that the elements are fully treated and ready for use.

EXAMPLE NO. 2

A plastification screw machined from a forging die steel with the designation 56 NiCrMoV 7 (Steel No. 2714 - DIN Standards, nominally containing 0.56% C, 1.1% Cr, 0.5% Mo, 1.65% Ni, and 0.18% V) is packed inside an elongated container of heat resistant steel sheet, in a packing of boron carbide powder. A corresponding plastification cylinder is similarly filled with a packing of boron carbide powder. In order to improve the surface of the elements, i.e. in order to supress any scale formation, the elements are borided under vacuum in the compartment furnace, the boriding treatment lasting for 8 hours, at a temperature of approximately 900° C. Following the boriding treatment, the plastification elements, including their surrounding packing, or their enclosed packing, respectively, are transferred vertically upwardly into a cooling zone located above the compartment furnace, where they are air-chilled to room temperature in 45 minutes. Since the austenitization temperature is about 850° C, the elements are fully treated as a result of the foregoing quenching operation.

EXAMPLE NO. 3

Plastification elements machined from a forging die steel with the designation 60 NiCrMoV 12 4 (Steel No. 2743 - DIN Standards, nominally containing 0.58% C, 1.15% Cr, 0.35% Mo, 2.85% Ni, and 0.1% V) are borided in accordance with the aforementioned powder pack boriding method, over a period of 7 hours, at a temperature of approximately 950° C. The plastification elements and their powder packing are then transferred into the cooling zone above the compartment furnace, where they are air-chilled to room temperature in 2 hours.

EXAMPLE NO. 4

Plastification elements obtained from X45 NiCrMo 4 (Steel No. 2767 - DIN Standards, nominally containing 0.4% C, 0.2% Si, 1.27% Cr, 0.24% Mo, and 4.03% Ni) are borided in the same manner as described in connection with Examples No. 1–3, for the time of 8 hours, at 900° C. The borided elements are then transferred into the cooling zone by lifting them out of their boron carbide packings with lifting wires. The cooling rate of the continuously circulating inert cooling medium, for example nitrogen, which is being re-cooled, is adjusted in such a way that the temperature of the plastification elements drops from the austenitization temperature to room temperature in 4 hours.

EXAMPLE NO. 5

Plastification elements obtained from a CrMo-alloyed hot working steel of the designation X 40 CrMoV 5 1 (Steel No. 2344 - DIN Standards, nominally containing 0.4% C, 1% Si, 5% Cr, 1.35% Mo, and 1.1% V), whose silicone content is reduced by approximately one-half, are borided in the manner described in connection with Examples No. 1–4, but at a temperature which is slightly above 1050° C. This steel has its austenitization temperature just below the eutectic temperature of the $Fe–Fe_2B$, so that a tempering treatment of the steel is possible. Immediately following the boriding treatment, which extends over 3 hours, the plastification elements, while remaining inside their boriding container and packings, are removed from the compartment furnace and dipped into an oil bath of a temperature which quenches the elements to room temperature in approximately 1 hour.

The remarkable economies resulting from the method of the invention stem, on the one hand, from the possibility of using comparatively inexpensive steels, and on the other hand, from a very considerable simplification in the treatment procedure, as far as tempering or hardening is concerned.

The recommended vacuum level for the boriding treatment is in the vicinity of 1/1000 millibar.

It should be understood, of course, that the foregoing disclosure describes only examplary applications of the method of the invention and that it is intended to cover all changes and modifications of these examples of application which fall within the scope of the appended claims.

We claim:

1. A method of producing surface-hardened machine elements of high abrasion resistance, especially plastification screws and plastification cylinders for injection molding machines in which thermoplastic or thermosetting plastic materials with mineral fillers, metallic fillers, or other highly abrasive fillers are processed, the method comprising the steps of:

selecting for the machine element a tool steel or a temper steel of less than 6 percent chromium content, whose austenitization temperature lies between 800° and 1100° C, a temperature at or below which the steel is susceptible to a boriding treatment;

shaping the machine element;

boriding the machine element in a ferro-boride producing packing at the prescribed boriding temperature, until a ferro-boride surface zone of the desired thickness is obtained; and chilling the borided machine element at a cooling rate which, in the Time-Temperature Transformation Diagram for Continuous Cooling, corresponds to a cooling line that lies outside the Pearlite Range and which also remains outside of, or only slightly intersects the Intermediate Range.

2. A method as defined in claim 1, wherein the step of chilling is performed prior to the removal of the machine element from its boriding packing.

3. A method as defined in claim 2, wherein the step of chilling is performed by means of a gaseous cooling medium.

4. A method as defined in claim 2, wherein the step of chilling is performed by means of an inert gaseous medium which is recirculated after recooling.

5. A method as defined in claim 1, wherein the step of boriding is performed under vacuum, inside a vacuum compartment of a compartment furnace; and the step of chilling includes the preliminary step of transferring the borided machine element from the vacuum compartment of the furnace to a gas cooling compartment, for cooling by means of a flow of inert gas.

6. A method as defined in claim 5, wherein the cooling compartment is located above the vacuum compartment of the furnace; and the step of transferring the machine element involves a vertical transfer between adjacent compartments of the compartment furnace.

7. A method as defined in claim 6, wherein the machine element remains in contact with the boriding packing, while it is transferred to the cooling compartment and while it is being cooled.

8. A method as defined in claim 6, wherein the machine element is removed from the boriding packing, as it is transferred vertically upwardly into the cooling compartment.

9. A method as defined in claim 1, wherein the step of selecting a steel involves the selection of an alloy steel having a nickel content of no more than 4 percent.

10. A method as defined in claim 1, wherein the step of selecting a steel involves the selection of a steel designated X 40 CrMoV 5-1 (Steel No. 2344, DIN Standards) of substantially the following composition:

0.4% C, 1% Si, 5% Cr, 1.35% Mo, and 1.1% V.

11. A method as defined in claim 1, wherein the step of selecting a steel involves the selection of a steel designated 55 NiCrMoV 6 (Steel No. 2713, DIN Standards) of substantially the following composition:

0.55% C, 0.85% Cr, 0.3% Mo, 1.65% Ni, and 0.1% V.

12. A method as defined in claim 1, wherein the step of selecting a steel involves the selection of a steel designated 56 NiCrMoV 7 (Steel No. 2714, DIN Standards) of substantially the following composition:

0.56% C, 1.1% Cr, 0.5% Mo, 1.65% Ni, and 0.18% V.

13. A method as defined in claim 1, wherein the step of selecting a steel involves the selection of a steel designated 60 NiCrMoV 12-4 (Steel No. 2743, DIN Standards) of substantially the following composition:

0.58% C, 1.15% Cr, 0.35% Mo, 2.85% Ni, and 0.1% V.

14. A method as defined in claim 1, wherein the step of selecting a steel involves the selection of a steel designated X 45 NiCrMo 4 (Steel No. 2767, DIN Standards) of substantially the following composition:

0.4% C, 0.2% Si, 1.27% Cr, 0.24% Mo, and 4.03% Ni.

* * * * *